US005533350A

United States Patent [19]

Gromala et al.

[11] Patent Number: 5,533,350

[45] Date of Patent: Jul. 9, 1996

[54] DEFROST CONTROL OF A REFRIGERATION SYSTEM UTILIZING AMBIENT AIR TEMPERATURE DETERMINATION

[75] Inventors: Joseph R. Gromala, Roselle; Vu T. Nguyen, Glendale Heights, both of Ill.

[73] Assignee: Robertshaw Controls Company, Richmond, Va.

[21] Appl. No.: 357,928

[22] Filed: Dec. 16, 1994

[51] Int. Cl.[6] ..... F25D 21/06

[52] U.S. Cl. ..... 62/155; 62/154; 62/156

[58] Field of Search ..... 62/155, 156, 234, 62/151, 229, 154

[56] References Cited

U.S. PATENT DOCUMENTS

| | | | |
|---|---|---|---|
| 4,373,349 | 2/1983 | Mueller | 62/155 X |
| 4,627,245 | 12/1986 | levine | 62/234 X |
| 5,363,669 | 11/1994 | Janke et al. | 62/234 X |

*Primary Examiner*—Harry B. Tanner

*Attorney, Agent, or Firm*—Robert J. Black

[57] ABSTRACT

A method for determining the time to begin and end a defrosting cycle of an evaporator included within a refrigeration system. Decisions as to initiate and terminate defrosting operations are predicated on information about the external temperature of the system and measuring differences in the rate of change of temperature drop between non-iced and iced conditions.

7 Claims, 3 Drawing Sheets

TABLE 1 TIME FROM COMPRESSOR ON TO 8°C DECREASE IN TEMPERATURE AT 25°C OUTSIDE TEMPERATURE.

| CYCLE X+? | COMPRESSOR ON TIMES(MIN.) | ICE BUILD-UP (MM) |
|---|---|---|
| 1 | 11 | 0.1 |
| 2 | 13 | 0.2 |
| 3 | 15 | 0.3 |
| 4 | 17 | 0.35 |
| 5 | 19 | 0.4 |
| 6 | 21 | 0.45 |
| 7 | 23 | 0.5 |
| 8 | 25 | 0.525 |
| 9 | 27 | 0.55 |
| 10 | 29 | 0.575 |
| 11 | 31 | 0.6 |
| 12 | 33 | 0.625 |
| 13 | 35 | .65 |

DRAWING 3. COMPRESSOR ON TIMES (FOR A CHANGE OF 8°C) VERSUS EVAPORATOR ICE THICKNESS

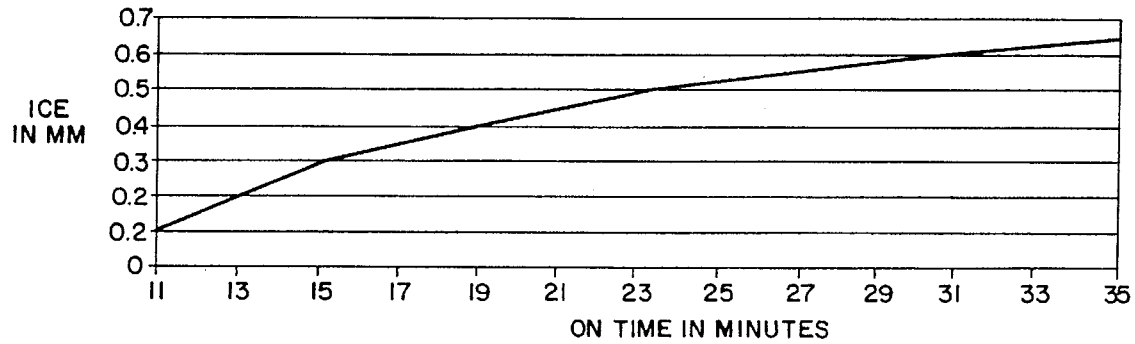

FIG. 3

TABLE I COMPRESSOR TIME CHANGE VS. EXTERNAL TEMPERATURE WITH ICE THICKNESS AT 0.4MM

| OUTSIDE TEMP (°C) | ON TIME (MIN.) |
|---|---|
| 11 | 15.5 |
| 13 | 16.0 |
| 15 | 16.5 |
| 17 | 17.0 |
| 19 | 17.5 |
| 21 | 18.0 |
| 23 | 18.5 |
| 25 | 19.0 |
| 27 | 20.0 |
| 29 | 21.0 |
| 31 | 23.0 |
| 33 | 25.0 |
| 35 | 27.0 |

DRAWING 4. COMPRESSOR ON TIME VS. TEMPERATURE (ICE AT 0.4MM)

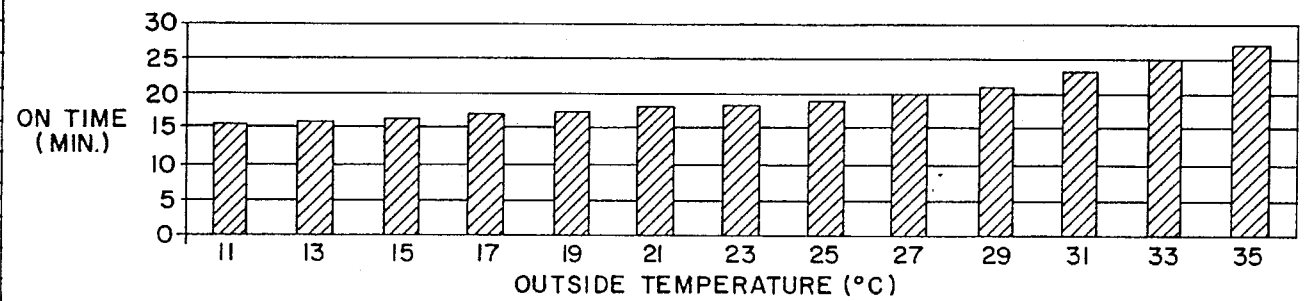

FIG. 4

DEFROST CONTROL OF A REFRIGERATION SYSTEM UTILIZING AMBIENT AIR TEMPERATURE DETERMINATION

BACKGROUND OF THE INVENTION

1. Field of the Invention

The present invention relates to household appliances, and more particularly to cooling systems such as those utilized in refrigerators, freezers and air conditioners.

2. Background Art

In the usual operation of appliances, such as refrigerators, freezers and even air conditioners, ice may build up on the evaporator included within the refrigeration system due to moisture in the air. Such ice build up reduces the efficiency of the system and decreases food preservation time because any act of defrosting causes warming of the air in contact with the melting ice.

In the past, a number of different ways have been utilized to determine the need for defrosting of the appliances. The usual techniques include various sensors on the evaporator to measure for ice presence. Some defrost methods are based purely on total time or run time of the compressor. Others frequently include combinations of the number of door openings, while still others employ a technique of recording how long a previous defrost in the appliance took by sensing the switch and comparing this to an optimum time that the switch should be operated. Such methods typically utilize the sensing of the operation of a bi-metallic switch.

A search of the background art directed to the subject matter of the present invention conducted in the U.S. Patent and Trademark Office disclosed the following U.S. Letters Patent:

U.S. Pat. No. 4,689,965 pertains to a control used in conjunction with a refrigeration system that includes defrosting apparatus for removing a frost load from the evaporator and means for energizing the defrosting apparatus at the end of a cooling cycle to initiate a defrost cycle.

U.S. Pat. No. 5,251,454 teaches the control of a defrost cycle of a refrigerator by placing a thermistor between the fins of the included evaporator. Comparator circuitry compares the temperature between that and a set point within the refrigerator.

U.S. Pat. No. 4,407,138 pertains to a control system for initiating the frost mode of operation in a heat pump wherein the ambient temperature is continuously monitored along with various other temperatures to determine appropriate control.

U.S. Pat. No. 5,257,506 pertains to a method for controlling a defrost cycle for effecting the defrost of an outdoor heat exchanger coil by initiating a defrost cycle as a function of outdoor coil temperature and outdoor air temperature.

U.S. Pat. No. 5,319,943 pertains to a microprocessor based control system for controlling frost accumulated on the outdoor evaporator coil of a heat pump.

U.S. Pat. No. 4,974,417 and 4,974,418 deal again with heat pump defrosting operations. These patents teach microprocessor control and the inclusion of exterior temperature sensors.

Based on a thorough review of the above-identified patents, we believe that none of the above teach, disclose or claim the novel combination of elements and functions found in the improved cooling system taught by the present invention.

SUMMARY OF THE INVENTION

In appliances such as refrigerators, freezers, etc,, when ice builds up inside on the evaporator included therein, thermal transfer of cold temperature from the evaporator to the air inside the refrigerator is reduced. It is this ice build up that slows down thermal transfer making the system inefficient. By measuring the amount of time the air inside a refrigerator compressor takes to change, it is possible to detect the build up of ice and initiate a defrost condition, It is well known that the external temperature of the refrigerator also effects the time the air takes to change and it is this differential that is accounted for, In a manner similar to that taught by our co-pending application entitled "DETERMINATION OF AMBIENT AIR TEMPERATURE OUTSIDE AN APPLIANCE" filed contemporaneously with the present application, we show testing is done with a refrigerator or similar device in a room of controlled external temperature to obtain reference timing. In this arrangement, a sensor is placed inside the refrigerator, either on the evaporator or somewhere else measuring air temperature. The length of time for the refrigerator to change temperature while the compressor is on is known as the cool down time. This is measured and correlated to external temperatures and different levels of ice build up on the evaporator. The time while the compressor is off is less accurate for determining defrost operations. Typically more ice build up will cause the air temperature to decrease at a slower rate.

With the availability of this information, a device such as a microcontroller may be placed within the refrigerator to utilize the reference information. By having a means to measure both the external temperature and the cool down times, the microcontroller can determine when the ice is too thick. The microcontroller compares stored information with the actual time it takes the evaporator to cool down between two predetermined temperatures. When it takes too long versus the stored information, a defrost cycle needs initiation.

It is also possible to utilize the same information or method to determine how long the defrost operation should occur instead of when to initiate the defrost cycle. Instead of waiting for a specific thickness of ice to build up, the microcontroller would run the compressor for a fixed number of cycles. It would then measure the cool down times, process this and utilize a table within the microcontroller based on reference information to vary the length of time the defrost cycle is actually performed.

Certain other factors could cause the inside temperature to change and thus effect cool down times. Such situations as the opening of the door on the box for a short time, letting in warmer or colder air. Also, the amount of mass of cold or warm objects that may be placed inside the box could cause a change. It is possible for these factors to be accounted for by sensing door openings or noticing a different time-temperature curve change than normally happens within the sealed system.

It is also possible that by measuring the time to get to an intermediate temperature point between two temperatures, the same or extra information might be obtainable. This information could then be utilized to detect openings in the box, or warmer or colder items placed within the box.

It is also possible for the desired inside temperature to be adjusted and changed. This clearly could affect the cool down time and must be compensated for. In each case, the microcontroller can properly adjust the reference times.

Accordingly, it is the object of the present invention to utilize the temperature of the air outside of the refrigerator to change defrost performance and decision times.

Yet another object shall be the measuring of time versus temperature change within the refrigerator or similar device to determine the need for a defrost cycle. This time measured must be the fall time or the time while the compressor is on which will show the differences in ice build up.

BRIEF DESCRIPTION OF THE DRAWINGS

A better understanding of the present invention may be had from consideration of the following detailed description taken in conjunction with the following drawings:

FIG. 3 is a table showing time for the compressor to reach a particular temperature at a particular outside temperature.

FIG. 4 is a graph showing compressor time change versus external temperature with ice thickness at 0.4 mm.

DETAILED DESCRIPTION OF THE PREFERRED EMBODIMENT

For a better and more thorough understanding of the present invention it will be described as being embodied into a refrigerator having a freezer compartment, for purposes of illustration. It must be understood, however, the invention is not limited to use only in refrigerators having freezers, but also in other appliances, such as freezers, air conditioners, etc.

Figure 1:
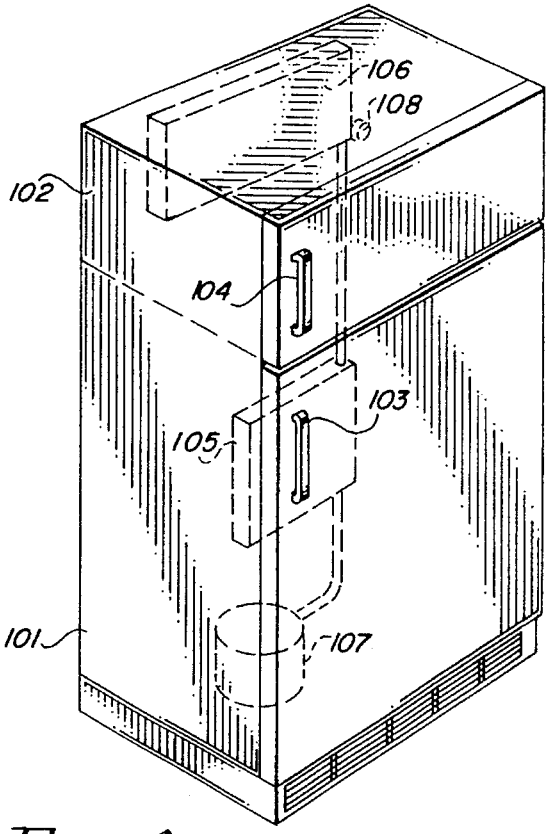
FIG. 1 is an isometric sketch of a refrigerator or similar device employing the teachings of the present invention.
Figure 2:
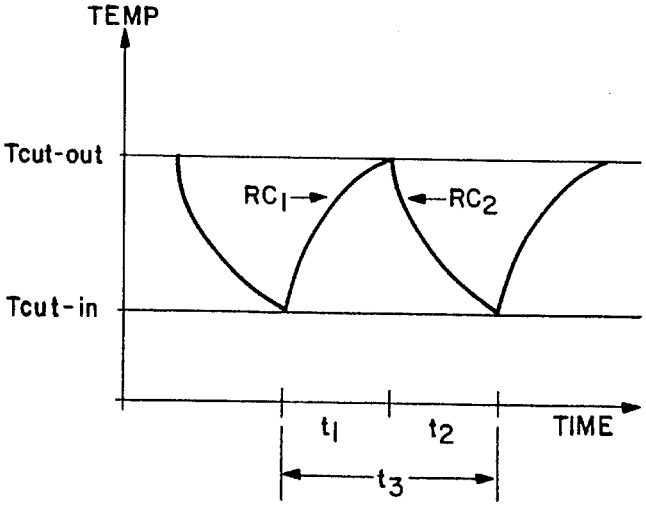
FIG. 2 is a drawing showing the effect of time versus temperature.

As shown in FIG. 1, a temperature sensor 108 is placed inside the freezer compartment 102 as seen in FIG. 1. The compressor 107 operates the evaporator 106 that goes on and off as shown in FIG. 2. A microcontroller or some other similar measuring device (not shown) included within the refrigerator measures the time it takes for a sensor temperature to rise and fall. For this purpose, $RC_2$ (as shown in FIG. 2) is measured by the sensor and the microcontroller. The microcontroller measures the "on" ($T_2$) and "off" ($T_1$) times as shown in FIG. 2, operating the compressor 107 to provide necessary cold.

To determine the proper operation, the refrigerator is placed in a room with varying temperatures. Data is taken by the microcontroller which correlates to the time the evaporator takes to decrease 8° C. with the room temperature and ice thickness which builds up on the evaporator. This data then becomes the reference time. Then the microcontroller will be placed within the same refrigerator or one of the same size with the microcontroller recording the time the compressor is on, the time the sensor takes to change temperature, and the room temperature of the refrigerator. From this data, comparisons are made to reference times and the microcontroller will decide that it is time to initiate a defrost cycle or to take more data. As may be seen by reference to the information shown in FIGS. 3 and 4, the freezer is placed in a room with controlled temperatures, with the data being recorded for the room temperature, inside freezer temperature, a record of time and monitoring of ice thickness on the evaporator within the freezer. Such recorded information is seen as indicated in FIGS. 3 and 4. FIG. 3 includes a curve showing the compressor on times for change of 8° C. versus evaporator ice thickness at a constant room temperature. While FIG. 4 includes a bar graph portion illustrating compressor on time versus room temperature at ice thickness on t he evaporator of 0.4 mm.

In accordance with the teachings of the present invention, the freezer unit is now placed in a room with varying temperatures. The freezer is set to control the average air temperature at a preset temperature. An included microcontroller monitors the temperature inside and outside of the freezer along with the energization state of the compressor 107. It is desired that the microcontroller operates to start a defrost cycle when the ice is built up to 0.4 mm or greater. Accordingly, the microprocessor is utilized to measure the time when the compressor first turns on to a change in temperature Of the sensor at 8° C. It also measures the outside temperature, which is 29° C. From FIG. 4, there is shown a correlation of a time change at 21 minutes or longer to 0.4 mm thick ice while at an ambient external temperature of 29° C. Again, the microcontroller will now monitor each cool down time of the compressor as it cycles for the desired average set temperature. As may be seen in FIG. 3, the time to change 8° C. takes longer and longer as the ice thickness increases. For each cycle of the compressor, the ice thickness will increase a little more. At some cycle of operation (X+3), the compressor will take 15 minutes to cause an 8° C. change. The microcontroller will then compare this to a reference time of 21 minutes and decides a defrost does not need to begin. With ten compressor cycles later, the 8° C. change time is 21 minutes. The microcontroller will then allow the compressor to stay on until the set temperature is met and then initiate the defrost. In this arrangement, 21 minutes implies that the thermal transfer from the evaporator to air is hindered by 0.4 mm thickness of ice on the evaporator.

Figure 5:
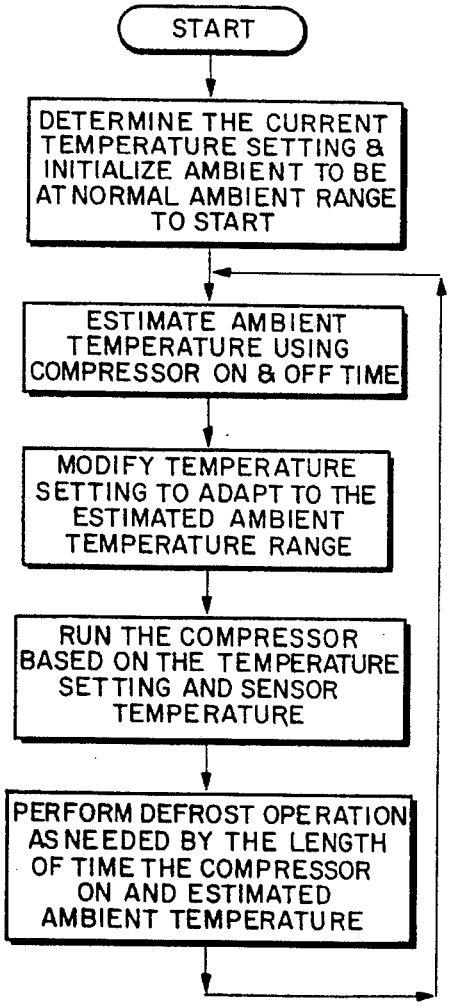
FIG. 5 is a chart illustrating the basic decisions employed in the present invention.
Figure 6:
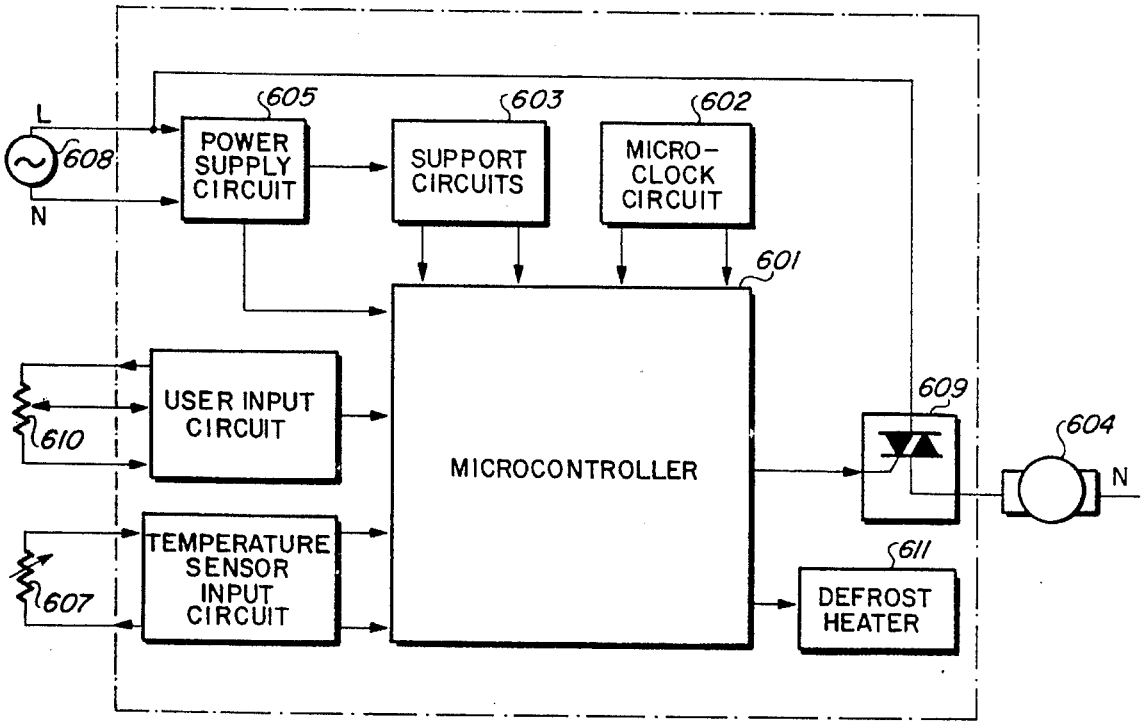
FIG. 6 is a block diagram of an appliance equipped with a method of defrost control utilizing ambient air temperature determination employing the present invention.

The equation is based on a simple algorithm decision which is shown in FIG. 5 taken in connection with the equipment shown in block diagram in FIG. 6.

It should be understood that while the operation of the elements in the present system have been shown in block diagram form, details thereof do not form a portion of the present invention. Rather, it only being required that the individual elements of the system perform in the manner which will be described hereinafter. Such operations all being well known and within the scope of those skilled in the art.

Referring now to FIGS. 5 and 6 in combination, discussion of a software routine for determining control of a defrost cycle will be discussed. Initially, microcontroller 601 determined the temperature setting established by potentiometer 610 to provide an initial ambient temperature to be within the normal ambient range prior to beginning of the cycle controlled program.

At this point in time, the microcontrol let will estimate ambient temperature measuring the on and off times of the cold producing element compressor 604. The information is based on the stored information previously determined and described.

The internal temperature initially established by means of potentiometer 610 within the microcontroller 601 will be modified to adapt to the estimated ambient temperature range. Compressor 604 will now be operated based on the temperature setting established by the controller and sensor information received from sensor 607, The defrost heater 611 will now be operated in response to the microcontroller as required by length of time determined by the microcontroller 601 and by the length of time compressor 604 has been on and the estimated ambient temperature currently stored within the microcontroller 601.

At the conclusion of the defrost time, the program is repeated beginning with the estimation of ambient temperature again utilizing compressor on and off time. As previously indicated, this may change depending upon the build up of ice on the evaporator 106. Thus, accordingly it can be seen that microcontroller 601 is effectively able to estimate by means of monitoring the off and on times of the compressor to provide an indication of the ambient temperature to control defrost cycle of the freezer unit to prevent extensive build up of ice therein, While but a single form of the present invention has been shown, it will be obvious to those skilled in the art that numerous modifications may be made without departing from the spirit of the present invention which shall be limited only by the scope of the claims appended hereto.

What is claimed is:

1. A method of controlling frost build-up in an appliance including a cold producing element, and a microcontroller, said method comprising the steps of:

determining the current temperature setting of said appliance;

establishing an estimated external ambient temperature;

measuring the on times of said cold producing element;

measuring the off times of said cold producing element;

estimating the ambient temperature at said off time measurement and at said on time measurement of said cold producing element by utilizing information stored in said micrcontroller;

operating said cold producing element in response to said temperature setting and temperature sensed within said appliance;

initiating a defrost operation for a length of time said cold producing element has been operated and said estimated ambient temperature.

2. A method of controlling frost build up as claimed in claim 1 wherein:

concluding said defrost operation step and repeating said estimating step of said ambient temperature utilizing said compressor on and off times.

3. A method of controlling frost build up as claimed in claim 1 wherein:

said cold producing element is a compressor.

4. A method of controlling frost build up as claimed in claim 1 wherein:

said measuring steps are performed by said microcontroller.

5. A method of controlling frost build up as claimed in claim 1 wherein:

said estimating step is performed by said microcontroller.

6. A method of controlling frost build up as claimed in claim 1 wherein:

said compressor control is in response to said microcontroller.

7. A method of controlling frost build up as claimed in claim 1 wherein:

said defrost operation is in response to said microcontroller.

* * * * *